United States Patent [19]

Kalin

[11] 3,994,230

[45] Nov. 30, 1976

[54] SELF-DESTRUCTION TYPE NOSE IMPACT FUZE FOR SPINNING PROJECTILES

[75] Inventor: Viktor Kälin, Einsiedeln, Switzerland

[73] Assignee: Werkzeugmaschinenfabrik Oerlikon-Buhrle AG, Zurich, Switzerland

[22] Filed: Aug. 27, 1975

[21] Appl. No.: 608,285

[30] Foreign Application Priority Data

Sept. 2, 1974 Switzerland ..... 11878/74

[52] U.S. Cl. ..... 102/79; 102/73 R

[51] Int. Cl.[2] ..... F42C 15/22

[58] Field of Search ..... 102/79, 80, 73, 70 R, 102/79 T

[56] References Cited

UNITED STATES PATENTS

| | | | |
|---|---|---|---|
| 2,750,889 | 6/1956 | Kuhn | 102/79 |
| 2,871,788 | 2/1959 | Guerne | 102/79 X |
| 3,033,115 | 5/1962 | Guerne | 102/79 X |
| 3,177,810 | 4/1965 | Kipfer | 102/73 R |
| 3,616,757 | 11/1971 | Berger | 102/79 |

FOREIGN PATENTS OR APPLICATIONS

| | | | |
|---|---|---|---|
| 1,185,093 | 1/1965 | Germany | 102/79 |
| 379,970 | 8/1964 | Switzerland | 102/79 |

*Primary Examiner*—David H. Brown
*Attorney, Agent, or Firm*—Werner W. Kleeman

[57] ABSTRACT

A self-destruction-type nose impact fuze for spinning projectiles comprising an axially displaceable firing pin which can be brought to bear at an axially displaceable impact body against the force of a self-destruction spring through the agency of centrifugal bodies as long as the spin of the projectile is above a boundary value decisive for the self-destruction. The impact body is located internally of a hollow compartment of the fuze housing, this hollow compartment being closed at the front. Within the aforementioned hollow compartment there is clamped a bushing between two oppositely situated support surfaces of the fuze housing. The bushing is internally provided with a shoulder against which bears an end surface of the impact body for the positive transmission of the impact shocks or percussions from the fuze housing forming the fuze tip to the impact body. Between the fuze housing and the outer wall of the bushing there is provided a hollow space or compartment, and the bushing consists of a material possessing a greater strength than that of the fuze housing.

3 Claims, 2 Drawing Figures

50
21a
4a
21
4
15b
17
40
36
15
15a
5
20
41
22
18
19
3a
16
32
14
25
13a
27
13
28
29
26
31
23
30
12
1
12a
24
7
11
8
9
10
2
6

SELF-DESTRUCTION TYPE NOSE IMPACT FUZE FOR SPINNING PROJECTILES

BACKGROUND OF THE INVENTION

The present invention relates to a new and improved construction of a self-destruction type nose impact fuze for spinning projectiles which is of the type comprising an axially displaceable firing or ignition pin which can be brought to bear at an axially displaceable impact body against the force of a self-destruction spring by centrifugal bodies —which bear against a ramp—, as long as the projectile spin is above a boundary value determinative of the self-destruction, the impact body being located internally of a hollow space or compartment of the fuze housing and which hollow space is closed towards the front.

According to a known fuze of this type the impact body directly bears at the front wall of the hollow space or compartment and the firing pin in turn bears by means of its end surface at the impact body. This bearing action, upon impact of the projectile, insures for the consistent utilization of the further transmission of energy from the mass of the fuze tip to the mass of the firing pin according to the laws of elastic impact or percussion.

However, the heretofore known prior art arrangement is associated with the drawback that for certain fields of application it is much too response-sensitive, i.e. the response time is so short that the projectile detonates when its greatest portion is still in front of the target. This is particularly disadvantageous when firing the projectile at aircraft.

SUMMARY OF THE INVENTION

Hence, it is a primary object of the present invention to provide an improved nose impact fuze for spinning projectiles which is not associated with the aforementioned drawbacks and limitations of the prior art proposals.

Another and more specific object of the present invention aims at the provision of a new and improved construction of fuze which responds with a certain time-delay so that detonation first then occurs when the major portion of the projectile has already penetrated a target, for instance the outer covering or skin of an aircraft.

A further objective of the invention is to provide a novel construction of fuze for a spinning projectile wherein the projectile itself is intended to have a somewhat greater flight or trajectory prior to its detonation than the prior art projectile. With a speed of the projectile of approximately 1000 m/sec there are thus required time-delays in the order of approximately $25 \times 10^{-5}$ sec. Such small time-delays are dependent upon a number of factors.

At the fuze itself the factors which come into consideration is the material, the configuration and the mass of the fuze housing, impact body and firing pin. At the target there is also of significance the material and the thickness of the wall which is to be penetrated.

Now with the foregoing in mind the fuze of this development is manifested by the features that in the aforementioned hollow space there is clamped a bushing between two oppositely situated support surfaces of the fuze housing. Internally of the bushing there is provided a shoulder against which bears an end surface of the impact body for the positive transmission of the impact shocks or pulses from the fuze housing forming the fuze tip to the impact body. Further, a hollow space or compartment is provided between the fuze housing and the outer wall of the bushing, and the bushing is formed of a material of greater strength than that of the fuze housing.

The elastic shock upon impact of the fuze tip at the target therefore must be transmitted from the fuze tip via the bushing and via the impact body to the firing or ignition pin, with the result that there is obtained the desired time-delay.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
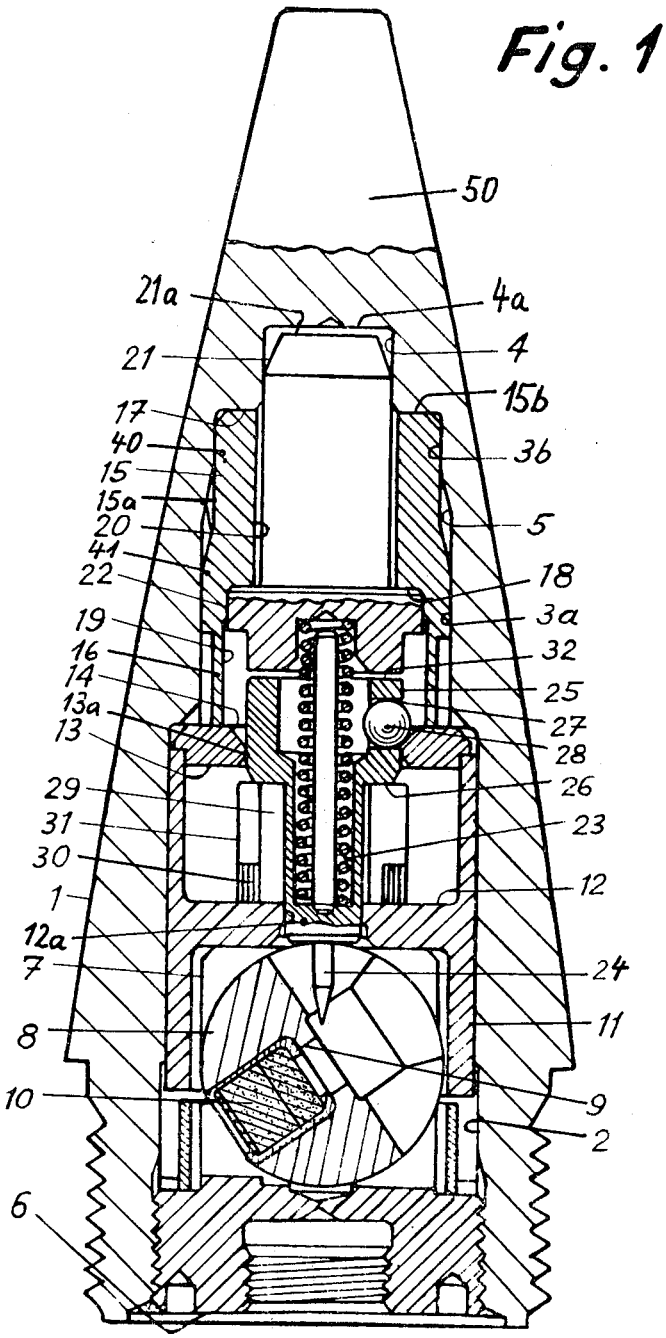
FIG. 1 is an axial partial sectional view through a fuze in the safety or unarmed position.

Describing now the drawings, according to the showing of fuze portrayed in FIG. 1 a substantially truncated conical-shaped fuze housing 1 formed of light metal, for instance, avional (aluminum-copper-magnesium alloy), possesses a central bore which is subdivided into four portions or sections possessing different diameters. The forwardmost bore portion 4 is a blindhole bore and possesses the smallest diameter. Thereafter there follow both of the bore sections or portions **3*a* and 3*b*, the transition of which is formed by a conical surface 5. A closure body 6 with a forwardly protruding cylindrical projection 7 is threaded into the rearmost bore portion 2 which possesses the largest diameter. A substantially disk-shaped rotor 8 is rotatably mounted in a not particularly referenced groove or recess of the projection 7. The rotor 8 has a continuous bore 9 into which there is inserted a detonator cap 10. The axis of the bore 9 together with the rearwardly directed fuse axis encloses an acute angle. A sleeve 11 arranged in the bore 2 has an intermediate bottom or floor 12 which extends essentially perpendicular to the axis of the fuze. The sleeve 11 bears through the agency of the intermediate floor 12 upon the projection or attachment 7. Connected with the front portion of the sleeve 11 is a ring or ring member 13 formed of steel, a conical-shaped bore 14 of which opens towards the front. A bushing 15 formed of a light metal alloy, for instance Perunal, is centered with very little play in the bore sections or portions 3*a*, 3*b*. The rear portion or region 16 of the bushing 15 possesses a smaller wall thickness than the front portion 40. A conical shoulder 15*a* of the bushing 15 is spaced from the bore portion or conical surface 5. The bushing 15 bears against the ring or ring member 13 and its front end surface 15*b* bears against a bore shoulder 17 of the housing 1, this bore shoulder 17 being directed essentially perpendicular to the lengthwise axis of the fuze. A stepped portion or shoulder 18 which is likewise disposed transversely with respect to the fuze axis separates two bore sections 19 and 20 of the bushing 15 from one another. The rear portion or section 16 and the front portion or section 40 of the bushing 15 possess a smaller external diameter than the intermediate section or portion 41**.

A cylindrical impact body 21 formed of steel is equipped with a flange 22. The impact body 21 extends with play through the bushing 15 and is centered and movably mounted in the bore portion or section 4 and by means of the flange 22 in the bore section or portion 19 of the bushing 15. The impact body 21, the end surface 21*a* of which possesses a spacing from the base 4a of the bore portion or section 4, is loaded by the forwardly effective force of a self-destruction type spring 22 and bears under the action thereof by means of the flange 23 at the stepped portion 18 of the bushing 15. A firing pin 24 possesses at its front end a sleeve 25 which is stepped in diameter. A shoulder of the sleeve 25 which is directed prependicular to the fuze axis has been designated by reference character 26. The sleeve 25 is guided in bores 13*a* and 12*a* of the ring 13 and the intermediate floor or bottom 12, respectively. The components of a self-destruction mechanism are arranged in conventional manner. In radial bores 27 of the sleeve 25 there are located substantially spherical- or ball-shaped centrifugal bodies 28, at the outside of which there is oppositely situated the conical surface or bore 14 of the ring or ring member 13. A likewise conventional safety or securing device for the sleeve 25 with the firing pin 24 consists of a slotted ring or ring member 29 provided with radial grooves and formed of light metal, a thin spiral band 30 wound thereon and a securing or safety band 31 enclosing the same. The sleeve 25 bears under the pressure of the spring 23 with its shoulder 26 at the ring 29. The ring-shaped end surface 32 of the sleeve 25 possesses a small spacing from the impact body 21.

Having now had the benefit of the above description of the fuze construction of this development its mode of operation will be now described and is as follows:

Upon passage of the projectile or the like through the firing barrel, after firing the same from a suitable weapon, the projectile which carries the fuze is placed into rotation or spin, the securing or safety band 31 opening under the action of the centrifugal force and bearing against the inner wall of the sleeve 11. The spiral band 30 and the ring 29, which are pressed against the intermediate floor or bottom 12 by virtue of the action of the inertia forces which engage thereat as well as at the sleeve 25 and the impact body 21, remain in the transport position according to FIG. 1.

Figure 2:
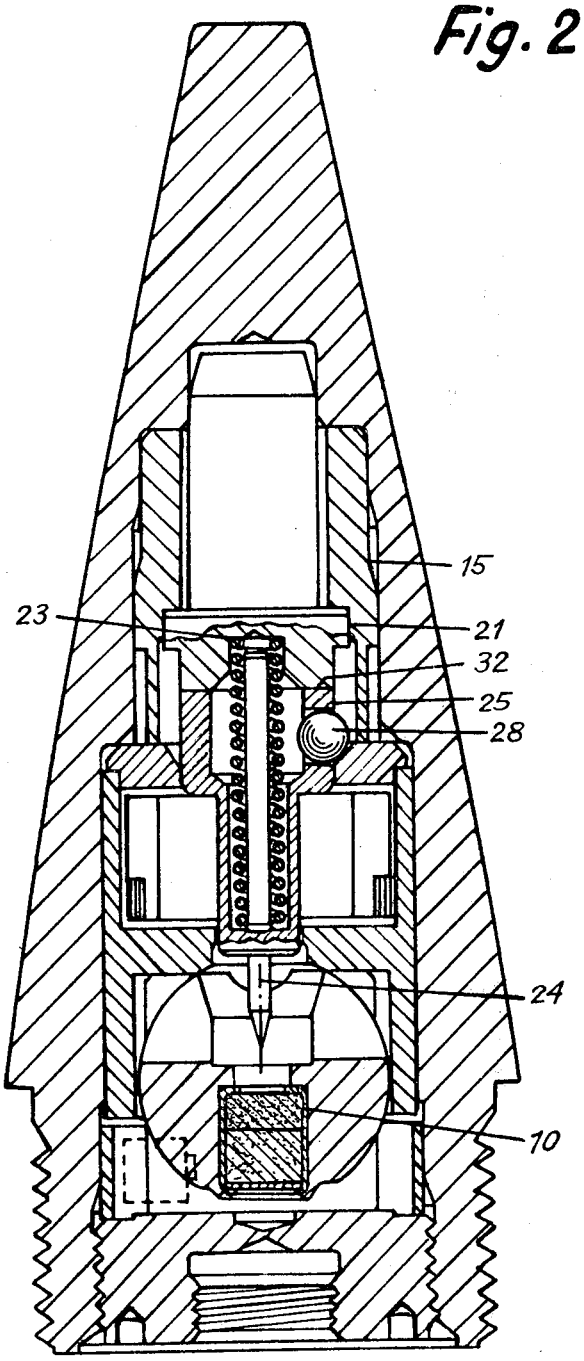
FIG. 2 illustrates the same fuze as portrayed in FIG. 1 but this time in the armed position or state.

After departure of the projectile out of the firing barrel of the weapon the rotor 8 rotates until the axis of the detonator cap 10 essentially coincides with the fuze axis. Furthermore, the spiral band 30 and the ring 29 open under the action of the centrifugal force. The centrifugal bodies 28 move outwardly in the bores 27 of the sleeve 25 and upwardly at the surface 14 of the ring 13, which surface 14 acts in the manner of a ramp. Consequently, the sleeve 25 is pulled forwardly until its end surface 32 comes to bear at the impact body 21 (FIG. 2). The sleeve 25 is held in this position as long as the spin of the projectile is above a boundary value which is decisive for the self-destruction.

Upon impact of the projectile at the target and penetration therethrough, for instance the sheet metal, plating or otherwise forming the outer skin or covering of an aircraft, the sleeve 25 has imparted thereto by means of the impact body 21 and by virtue of the elastic shock a rearwardly directed impulse. This impulse together with the rearwardly directed force of the self-destruction spring 21 brings about that the forwardly directed component of the force transmitted from the centrifugal bodies 28 to the sleeve 25 is overcome and such together with the firing or ignition pin 24 is propelled against the detonator cap 10. Consequently, there is initiated the detonation of the explosive charge of the projectile and which charge has not been particularly illustrated in the drawings since the same is quite conventional and well known to those skilled in the art. As tests have shown the bushing 15 acts in the sense that the shock or percussion at the sleeve 25, after impact of the projectile at the target, is exerted with a time-delay in such a manner that the projectile first detonates when it has penetrated for the most part through the target sheet metal or the like i.e. the body of the target. While applicant does not wish to be bound to any particular theory, it is assumed that due to the bushing 15 the propagation of a shock wave is retarded or delayed since the elastic shock, upon impact of the fuze tip 50, at the target, must be transmitted from the fuze tip via the bushing 15 and via the impact body 21 to the firing pin 24, so that there is obtained the desired enlargement of the response time.

The magnitude of the response delay of the fuze can be influenced within certain limits due to the mass of the impact body 21 and the bushing 15, and furthermore by means of the material from which there is formed these components. Furthermore, the shape or configuration of the bushing 15 plays a certain role.

As mentioned the rear portion 16 of the bushing has a smaller wall thickness than the front portion 40, as the same is apparent from the showing of the drawings. This is particularly of significance when the projectile impacts against the armor plates of tanks and the danger exists that the fuze housing, already prior to detonation, becomes deformed so markedly that the firing pin jams and no longer is capable of penetrating the fuze capsule. The rear end of the bushing then forms a so-called crumple- or crease-zone preventing deformation of the supporting ring located therebehind, since by virtue of such deformation of the ring the firing pin could become jammed at the region of the sleeve.

While there is shown and described present preferred embodiments of the invention, it is to be distinctly understood that the invention is not limited thereto, but may be otherwise variously embodied and practiced within the scope of the following claims.

What is claimed is:

1. A self-destruction nose impact fuze for spinning projectiles, comprising:

A. a fuze housing including a fuze tip and containing
   a. a forwardly closed hollow compartment,
   b. means defining a ramp,
   c. centrifugal bodies bearing against said ramp,
   d. an axially displaceably firing pin,
   e. a detonator cap against which said firing pin in propelled,
   f. a self-destruction spring cooperating with said firing pin,
   g. an axially displaceable impact body located internally of the hollow compartment and cooperating with said self-destruction spring,
   h. a ring member fixed in said fuze housing,
   i. a bore shoulder in said hollow compartment,
   j. a bushing clamped in the hollow compartment between said bore shoulder and said ring member, B. the axially displaceable firing pin being brought to bear against the axially displaceable impact body against the force of the self-destruction spring by the centrifugal bodies bearing against said ramp as long as the spin of the projectile is located above a boundary value determinative of self-destruction, C. the bushing having an outer wall and internally possessing a shoulder against which bears an end face of the impact body under the force of said self-destruction spring for the positive transmission of the impact impulse from the fuze tip of the fuze housing to the impact body, D. a hollow space provided between the fuze housing and the outer wall of the bushing, and E. wherein the bushing is formed of a material of greater strength than the fuze housing.

2. The self-destruction nose impact fuze as defined in claim 1, further including a sleeve cooperating with said firing pin, the bushing having a rear portion and a front portion, the rear portion of the bushing possessing a smaller wall thickness than the front portion in order to form a crease zone preventing clamping of the firing pin at the region of the sleeve.

3. A self-destruction nose impact fuze for spinning projectiles, comprising:

a. a fuze housing;

b. an axially displaceable firing pin arranged within said fuze housing;

c. a self-destruction spring cooperating with said firing pin;

d. an axially displaceable impact body cooperating with said firing pin;

e. a detonator cap against which said firing pin is propelled;

f. a ring member fixed in said housing;

g. a bore shoulder in said fuze housing;

h. a bushing supported in the fuze housing between said bore shoulder and said ring member;

i. said bushing having an outer wall and internally possessing a shoulder against which bears the impact body under the force of said self-destruction spring in order to transmit an impact impulse from the fuze housing to the impact body;

j. a hollow space provided between the fuze housing and the outer wall of the bushing; and k. the bushing being formed of a material of greater strength than the fuze housing.

* * * * *